US009224328B2

(12) United States Patent
Kim et al.

(10) Patent No.: US 9,224,328 B2
(45) Date of Patent: Dec. 29, 2015

(54) ORGANIC ELECTRO LUMINESCENCE DISPLAY DEVICE AND DRIVING METHOD THEREOF

(75) Inventors: Hak Su Kim, Seoul (KR); Jae Do Lee, Gyeongsangbuk-do (KR); Won Kyu Ha, Gyeongsangbuk-do (KR)

(73) Assignee: LG DISPLAY CO., LTD., Seoul (KR)

( * ) Notice: Subject to any disclaimer, the term of this patent is extended or adjusted under 35 U.S.C. 154(b) by 1755 days.

(21) Appl. No.: 11/139,779

(22) Filed: May 31, 2005

(65) Prior Publication Data

US 2005/0264499 A1 Dec. 1, 2005

(30) Foreign Application Priority Data

Jun. 1, 2004 (KR) ..... 10-2004-0039748
Jun. 9, 2004 (KR) ..... 10-2004-0042115

(51) Int. Cl.
*G09G 3/30* (2006.01)
*G09G 3/32* (2006.01)

(52) U.S. Cl.
CPC ..... *G09G 3/3216* (2013.01); *G09G 2300/0408* (2013.01); *G09G 2310/0248* (2013.01); *G09G 2330/021* (2013.01)

(58) Field of Classification Search
CPC ..... G09G 2310/0251; G09G 3/3241; G09G 2320/0233; G09G 2320/043; G09G 3/3283; G09G 3/3233; G09G 2320/0252; G09G 2310/027; G09G 2300/0819; G09G 2320/0223; G09G 2310/0248; G09G 3/3208; G09G 3/3266; G09G 2310/0243; G09G 2310/0245; G09G 2310/0259; G09G 3/30; G09G 3/32
USPC ..... 345/36, 39, 44, 45, 46, 52, 53, 205, 345/206, 208, 209, 210, 211, 213, 214, 215, 345/690, 691, 692, 693, 589, 76–204, 48, 345/55; 315/169.1–169.4; 313/463; 257/40; 365/203
See application file for complete search history.

(56) References Cited

U.S. PATENT DOCUMENTS 6,229,508 B1 * 5/2001 Kane ..... 345/82
6,332,661 B1 * 12/2001 Yamaguchi ..... 327/108
(Continued)

FOREIGN PATENT DOCUMENTS

JP 2011296837 A 10/2001
JP 2003114645 A 4/2003
(Continued)

*Primary Examiner* — Kent Chang
*Assistant Examiner* — Herbert L Hagemeier
(74) *Attorney, Agent, or Firm* — Birch, Stewart, Kolasch & Birch, LLP

(57) ABSTRACT

A method for controlling an organic electro luminescence display device, the device including a display panel including a plurality of data lines that cross a plurality of scan lines, and including electro luminescence elements arranged at intersections of the plurality of data lines and the plurality of scan lines; a pre-charge driver configured to select one of a plurality of pre-charge current levels in accordance with a gray level of incoming data, and supply a pre-charge current, corresponding to the selected one of the plurality of pre-charge current levels, to the electro luminescence elements via the plurality of data lines prior to supplying a data current, corresponding to the incoming data, to the electro luminescence elements, so as to pre-charge the electro luminescence elements; and a data driver configured to subsequently supply the data current to the pre-charged electro luminescence elements via the plurality of data lines.

5 Claims, 14 Drawing Sheets

(56) References Cited

U.S. PATENT DOCUMENTS

| | | | | |
|---|---|---|---|---|
| 6,756,957 | B2 * | 6/2004 | Park | 345/92 |
| 6,876,225 | B2 * | 4/2005 | Yagishita et al. | 326/30 |
| 6,989,826 | B2 * | 1/2006 | Kasai | 345/204 |
| 7,034,781 | B2 * | 4/2006 | Irmer et al. | 345/76 |
| 7,071,904 | B2 * | 7/2006 | DeCaro et al. | 345/76 |
| 7,106,281 | B2 * | 9/2006 | Kim et al. | 345/76 |
| 7,209,101 | B2 * | 4/2007 | Abe | 345/76 |
| 2001/0024186 | A1 * | 9/2001 | Kane et al. | 345/98 |
| 2002/0167471 | A1 * | 11/2002 | Everitt | 345/76 |
| 2002/0167474 | A1 * | 11/2002 | Everitt | 345/82 |
| 2003/0030602 | A1 * | 2/2003 | Kasai | 345/76 |
| 2003/0038760 | A1 * | 2/2003 | Kim et al. | 345/76 |
| 2003/0161189 | A1 * | 8/2003 | Park | 365/189.07 |
| 2003/0169241 | A1 * | 9/2003 | LeChevalier | 345/204 |
| 2003/0173904 | A1 * | 9/2003 | LeChevalier | 315/169.3 |
| 2004/0004590 | A1 * | 1/2004 | LeChevalier | 345/82 |
| 2004/0222950 | A1 * | 11/2004 | Kimura | 345/76 |
| 2004/0232952 | A1 * | 11/2004 | Kimura et al. | 327/108 |
| 2004/0233148 | A1 * | 11/2004 | Tanghe et al. | 345/83 |
| 2004/0246224 | A1 * | 12/2004 | Tsai et al. | 345/100 |
| 2004/0263440 | A1 * | 12/2004 | Kimura et al. | 345/76 |
| 2005/0007181 | A1 * | 1/2005 | Kimura | 327/524 |
| 2005/0030267 | A1 * | 2/2005 | Tanghe et al. | 345/82 |
| 2005/0168490 | A1 * | 8/2005 | Takahara | 345/690 |
| 2005/0179625 | A1 * | 8/2005 | Choi et al. | 345/76 |
| 2006/0050032 | A1 * | 3/2006 | Gunner et al. | 345/82 |
| 2007/0018916 | A1 * | 1/2007 | Kim et al. | 345/76 |
| 2007/0057628 | A1 * | 3/2007 | Kim | 313/504 |
| 2007/0139308 | A1 * | 6/2007 | Kim et al. | 345/76 |
| 2007/0146394 | A1 * | 6/2007 | Ahn | 345/690 |
| 2008/0001865 | A1 * | 1/2008 | Kim et al. | 345/84 |
| 2008/0007551 | A1 * | 1/2008 | Kim | 345/214 |

FOREIGN PATENT DOCUMENTS

| | | | | |
|---|---|---|---|---|
| KR | 2003-0017931 | A | 3/2003 | |
| KR | 2003-0069652 | A | 8/2003 | |
| NL | WO2004/047065 | * | 6/2004 | G09G 3/32 |
| WO | WO 2004047065 | A1 * | 6/2004 | G09G 3/32 |

* cited by examiner

ORGANIC ELECTRO LUMINESCENCE DISPLAY DEVICE AND DRIVING METHOD THEREOF

This application claims the benefit of the Korean Patent Application Nos. P2004-39748 and P2004-42115 filed on Jun. 1, 2004, and, on Jun. 9, 2004 which are hereby incorporated by reference.

BACKGROUND OF THE INVENTION

1. Field of the Invention

The present invention relates to an electro luminescence display device, and more particularly to an organic electro luminescence display device using a pre-charge, and a driving method thereof.

2. Description of the Related Art

Recently, there have been developed various flat panel displays that can reduce their weight and size which are the disadvantages of the cathode ray tube CRT. The flat panel display includes the liquid crystal display LCD, the field emission display FED, the plasma display panel PDP, the electro luminescence EL display device and etc.

The PDP is relatively simple in its structure and fabricating process, thus it is most advantageous in being made into large screen, but there is a big disadvantage in that its luminous efficiency and brightness is low and its power consumption is high.

The LCD is mainly used as a display device of a notebook computer and its demand is increasing. However, the LCD is fabricated by a semiconductor process, thus there is difficulty in being made into large screen. And, the LCD is not a self luminous device, and as such requires a separate light source, thus there is a disadvantage in that its power consumption is high due to the light source. Further, the LCD has a disadvantage in that its viewing angle is narrow and light loss is great due to optical devices such as a polarizing sheet, a prism sheet, a diffusion plate and etc.

The EL display device is generally classified into an inorganic EL display device and an organic EL display device, and it has an advantage in that its response speed is fast and its luminous efficiency, brightness and viewing angle is big. The EL display device can display a picture at a high brightness of tens of thousands of [cd/m$^3$] by a voltage of about 10[V], and it has been applied to most of the EL display devices which are commonly used.

A unit element of the organic EL display device, as shown in FIG. 1, includes an anode 2 formed of a transparent conductive material on a glass substrate 1; and a hole injection layer 3, a light-emitting layer 4 formed of an organic material and a cathode 5 formed of a metal having a low work function are deposited thereon. If an electric field is applied between the anode 2 and the cathode 5, holes within the hole injection layer 3 and electrons within the metal are progressed to and combined together in the light-emitting layer 4. Then, a phosphorous material within the light-emitting layer 4 is excited and transited to generate a visible light. At this moment, the brightness is in proportion to a current between the anode 2 and the cathode 5.

The organic EL display device is divided into passive type and active types.

FIG. 2 is a circuit diagram equivalently representing part of a passive type organic EL display device, and FIG. 3 is a waveform representing scan signal and data signal waveforms of the passive type organic EL display device.

Referring to FIGS. 2 and 3, the passive type EL display device includes a plurality of data lines D1 to D3 and a plurality of scan lines S1 to S3 which cross each other; and organic EL elements OLED formed at intersections between the data lines DL1 to D3 and the scan lines S1 to S3.

The data lines D1 to D3 are connected to the anode of the organic EL element OLED to supply data currents Id to the anode of the organic EL element OLED.

The scan lines S1 to S3 are connected to the cathode of the organic EL element OLED to supply scan pulses SP1 to SP3 synchronized with the data currents Id to the cathode of the organic EL element OLED.

The organic EL element OLED emits light in proportion to the current flowing between the anode and the cathode for a display period DT when the scan pulses SP1 to SP3 are applied.

The organic EL elements OLED of the organic EL display device are charged with the current for a response time RT which is delayed by resistance components of the data lines D1 to D3 and a capacitance which is in the organic EL elements OLED, thus there is a problem in that the response speed and brightness are low. In order to compensate the low response speed of the organic EL elements OLED, there has recently been a trend that a pre-charge period PCHA is provided as a non-display period between the display periods DT and the organic EL elements OLED are pre-charged during the pre-charge period PCHA. However, even though the organic EL display device is pre-charged, there is a problem in that the response time RT of the organic EL elements OLED is lengthened in a low gray level as in FIG. 4.

Further, in a driving method of pre-charging the organic EL display device, there is a problem in that the response speed is fast but the organic EL elements OLED are over-charged by an overshoot in a high gray level. This is because the pre-charged current Ipre is fixed to be the value of gray level of data x the pre-charged constant "10" regardless of the gray level of data as in FIG. 5. The current Ioled of the organic EL elements OLED which is charged with the fixed pre-charged current Ipre increases exponentially as the gray level increases as in FIG. 6. As a result, if the organic EL elements OLED are driven by the pre-charging method, its brightness is not changed linearly but increases exponentially as the gray level increases, thus there is a problem in that the gray level expression ability becomes low.

Besides, most of the pre-charging method used currently has a problem in that power consumption is high and the current is not sufficiently pre-charged to the organic EL element OLED in the low gray level range such that the gray level expression ability is low in the low gray level.

SUMMARY OF THE INVENTION

Accordingly, it is an object of the present invention to provide an organic electro luminescence display device that there is no overcharge, its response speed is fast and its gray level expression ability is high, and a driving method thereof.

Further, it is another object of the present invention to provide an organic electro luminescence display device that consumes low power and has high gray level expression ability in a low gray level, and a driving method thereof.

In order to achieve these and other objects of the invention, an organic electro luminescence display device according to an aspect of the present invention includes: a display panel where a plurality of data lines cross a plurality of scan lines, and electro luminescence elements are arranged at intersections thereof; a pre-charge driver to select a current which is different in accordance with a gray level of data and to supply the pre-charge current to the electro luminescence elements through the data line; and a data driver to supply a data to the electro luminescence elements which are charged with the pre-charge current.

The organic electroluminescence display device further includes: a scan driver to supply a scan pulse synchronized with the data to the scan lines.

The organic electro luminescence display device further includes: a lookup table in which a pre-charge current data is registered, wherein the pre-charge current data indicates the current amount of the pre-charge current in correspondence to a gray level of the data; and a controller which judges the gray level of data, reads the pre-charge current data corresponding to the gray level of the data, and controls the pre-charge driver in accordance with the pre-charge current data.

In the organic electro luminescence display device, the pre-charge driver includes: a plurality of current sources of which current values are different from one another; a selection part to select any one of the plurality of current sources as the pre-charge current; and a first switch device to supply the pre-charge current to the data line for a non-display period.

In the organic electro luminescence display device, the data driver includes: a second switch device to supply the data current to the data line for a display period subsequent to the non-display period.

In the organic electro luminescence display device, the pre-charge current has the same current value within a gray level range inclusive of a plurality of gray levels and a different current value in gray levels out of the gray level range.

A driving method of an organic electro luminescence display device where a plurality of data lines cross a plurality of scan lines and electro luminescence elements are arranged at intersections thereof, according to another aspect of the present invention includes the steps of: selecting a pre-charge current which is different in accordance with a gray level of data; supplying the pre-charge current to the electro luminescence elements through the data line; and supplying a data to the electro luminescence elements which are charged with the pre-charge current.

The driving method further includes the step of: supplying a scan pulse synchronized with the data to the scan lines.

The driving method further includes the step of: providing a pre-charge current data which indicates the current amount of the pre-charge current in correspondence to a gray level of the data; and judging the gray level of data, reading the pre-charge current data corresponding to the gray level of the data, and controls the pre-charge current in accordance with the pre-charge current data.

In the driving method, the step of selecting the pre-charge current includes the step of: selecting any one of a plurality of current sources, of which the current values are different from one another, as the pre-charge current; and supplying the pre-charge current to the data line for a non-display period.

In the driving method, the step of charging the electro luminescence elements with the data includes the step of: supplying the data to the data line for a display period subsequent to the non-display period.

An organic electroluminescence display device according to still another aspect of the present invention includes: a display panel having a plurality of data lines; a gray level judgment part to judge a gray level of data; and a pre-charge driver to generate a charge or discharge in the data line for a non-scan period if a gray level of the data is a gray level below a designated reference gray level, which is lower than a maximum gray level, in accordance with a gray level judgment result from the gray level judgment part.

The organic electro luminescence display device further includes a data comparison part to compare current data with previous data.

In the organic electro luminescence display device, the pre-charge driver has the data line charged for the non-scan period if a gray level of the data is higher than the reference gray level in accordance with a gray level judgment result from the gray level judgment part and the data is higher than the previous data in accordance with a comparison result from the data comparison part.

In the organic electro luminescence display device, the pre-charge driver generate a discharge in the data line for the non-scan period if a gray level of the data is higher than the reference gray level in accordance with a gray level judgment result from the gray level judgment part and the data is lower than the previous data in accordance with a comparison result from the data comparison part.

A driving method of an organic electro luminescence display device having a plurality of data lines, according to still another aspect of the present invention includes the steps of judging a gray level of data; and generating a charge or discharge in the data line for a non-scan period if a gray level of the data is a gray level below a designated reference gray level, which is lower than a maximum gray level, in accordance with a gray level judgment result.

The driving method further includes comparing current data with previous data.

The driving method further includes the step of: having a charge generated in the data line for the non-scan period if a gray level of the data is higher than the reference gray level in accordance with a gray level judgment result and the data is higher than the previous data in accordance with the data comparison result.

The driving method further includes the step of: having a discharge generated in the data line for the non-scan period if a gray level of the data is higher than the reference gray level in accordance with a gray level judgment result and the data is lower than the previous data in accordance with the data comparison result.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 7 to 14.

Figure 1:
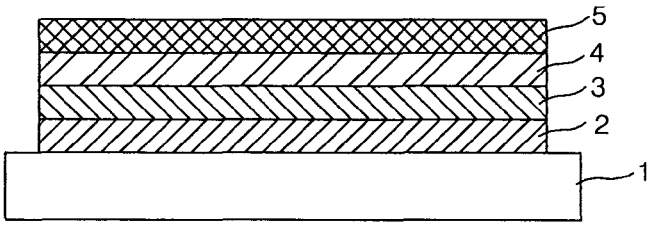
FIG. 1 RELATED ART
FIG. 1 is a sectional diagram briefly representing a unit element of a related art organic electro luminescence display device.
Figure 2:
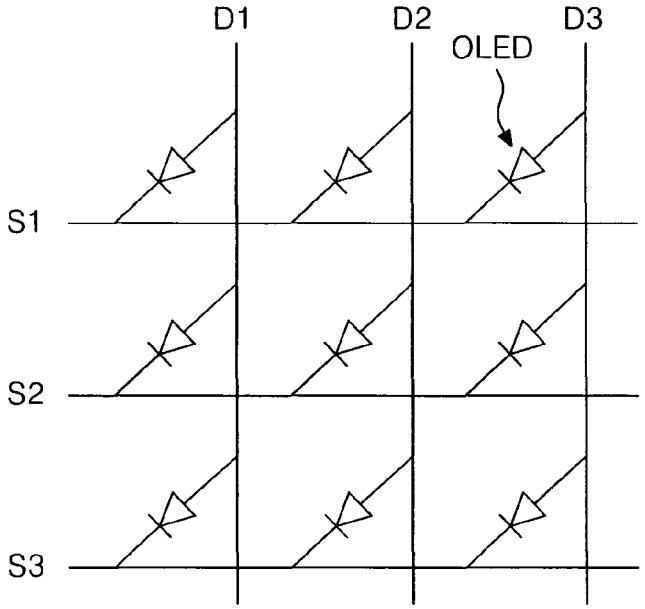
FIG. 2 RELATED ART
FIG. 2 is a diagram equivalently representing part of an array of a passive type organic electro luminescence display device.
Figure 3:
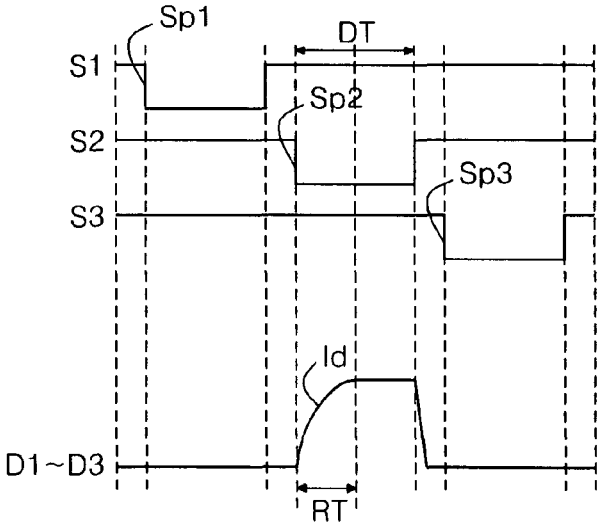
FIG.3 RELATED ART
FIG. 3 is a waveform diagram representing a delay of a response time which is generated in a driving method of the related art organic electro luminescence display device.
Figure 4:
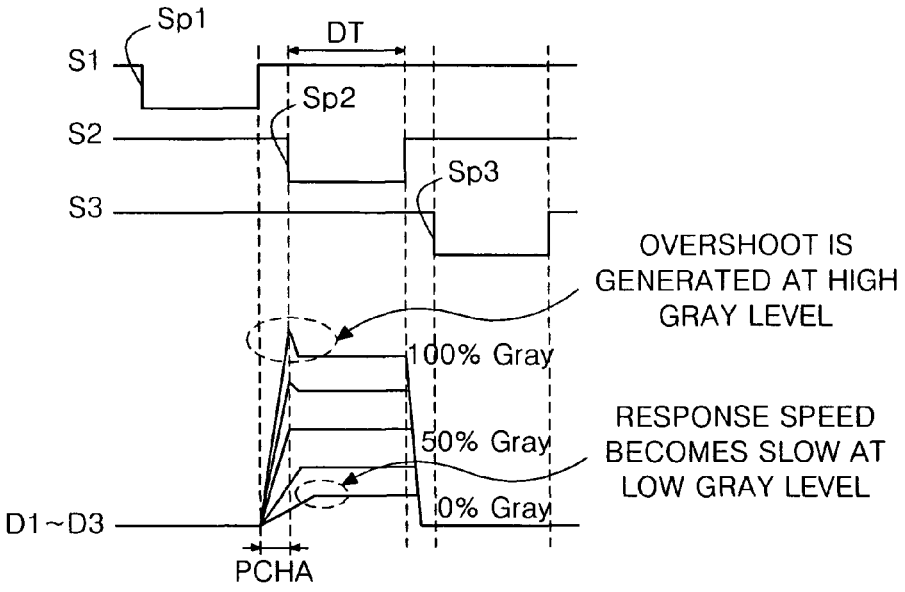
FIG. 4 RELATED ART
FIG. 4 is a waveform diagram representing a related art pre-charge driving method.
Figure 5:
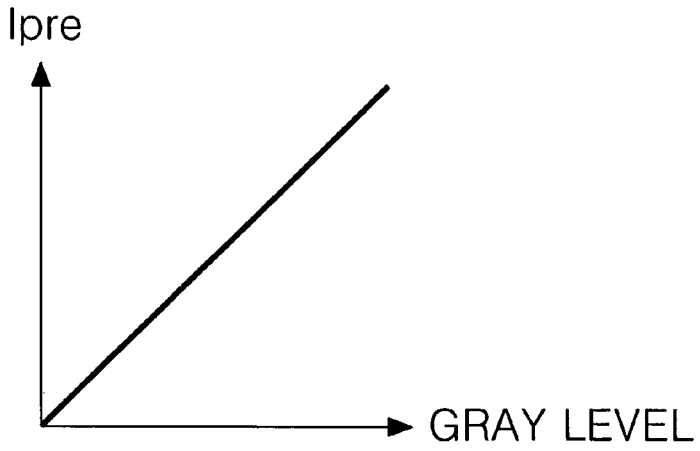
FIG. 5 RELATED ART
FIG. 5 is a graph representing a pre-charge current applied to the pre-charge driving method as in FIG. 4.
Figure 6:
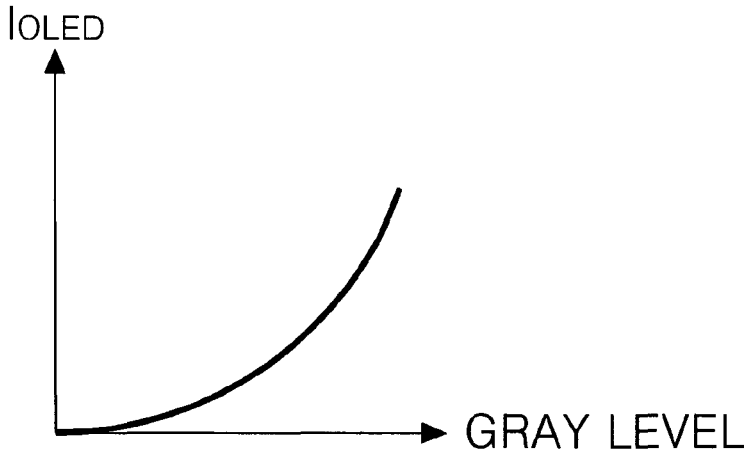
FIG.6 RELATED ART
FIG. 6 is a graph representing a deterioration of gray level expression ability resulted from the pre-charge driving method as in FIG. 4.
Figure 7:
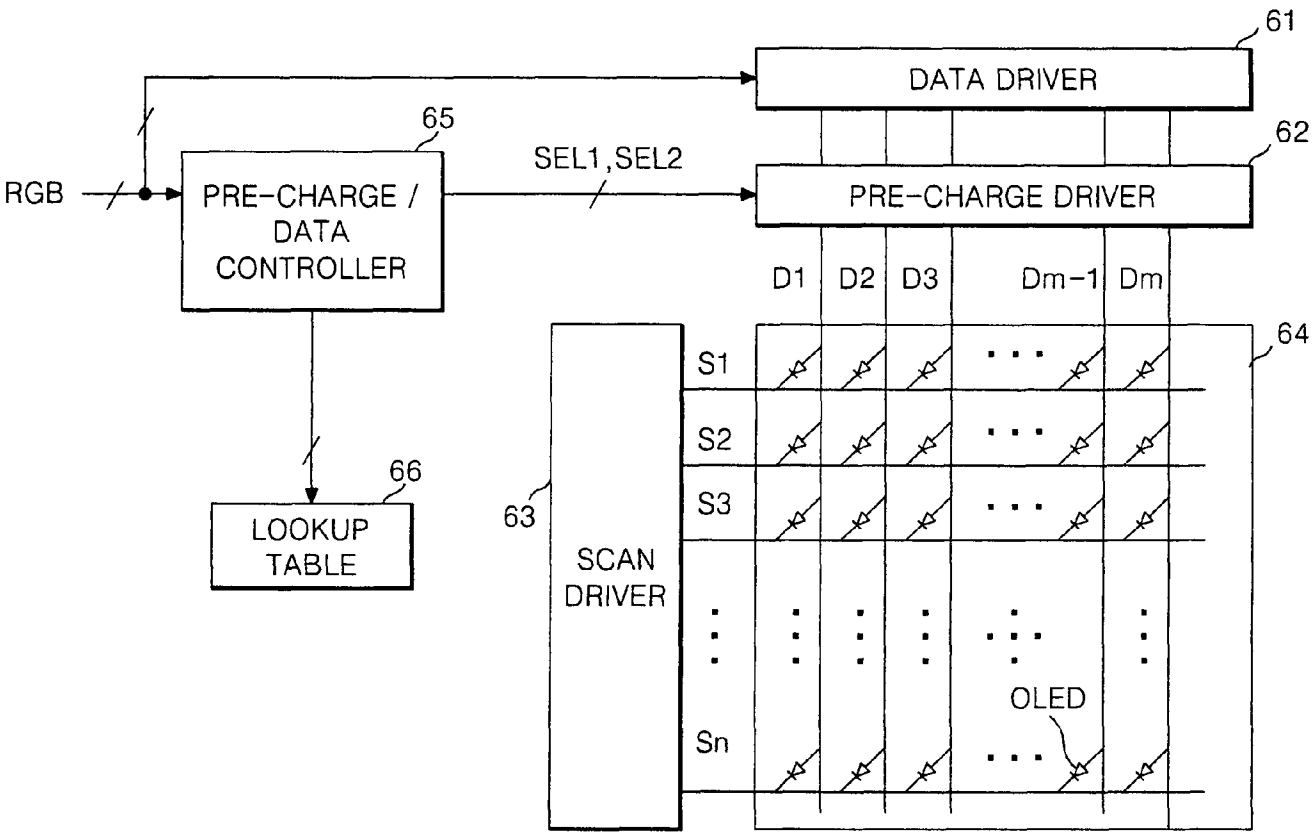
FIG. 7 is a block diagram representing an organic electro luminescence display device according to a first embodiment of the present invention.

Referring to FIG. 7, the organic EL display device according to the first embodiment of the present invention includes a display panel 64 where m×n numbers of organic EL elements OLED are arranged in a matrix type; a data driver 61 to generate a data current; a pre-charge driver 62 to generate a pre-charge current; a scan driver 63 to generate a scan pulse which is synchronized with the data current; and a pre-charge/data controller 65 to control the pre-charge driver 62 in accordance with a lookup table 66.

In the display panel 64, m numbers of data lines D1 to Dm and n numbers of scan lines S1 to Sn cross each other and the organic EL elements OLED are arranged between intersections thereof.

The data driver 61 includes a shift register circuit to sequentially sample data, and a current source of a current mirror circuit or a current sink circuit. The data driver 61 samples a digital video data and supplies a data current corresponding to the gray level value of the digital video data RGB to the data lines D1 to Dm through the pre-charge driver 62.

The pre-charge driver 62 makes a pre-charge current different in accordance with the gray level of the data RGB under control of the pre-charge/data controller 65, and supplies the pre-charge current to the data lines D1 to Dm prior to the data current.

The scan driver 63 includes a shift register circuit to sequentially shift a scan pulse and sequentially supplies a scan pulse synchronized with the data current to the scan lines S1 to Sn.

The pre-charge/data controller 65 judges the gray level value of the digital video data RGB and reads a pre-charge current data corresponding to the gray level value in the lookup table 66. And, the pre-charge/data controller 65 receives a vertical/horizontal synchronization signal and a clock signal (not shown), selectively generates control signals SEL1, SEL2 corresponding to the pre-charge current data, and controls the pre-charge driver 62 by use of the control signals SEL1, SEL2. Herein, the first control signal SEL1 is a control signal that is for being generated during a scan period, i.e., the pre-charge period, prior to the display period to select the amount of pre-charge current, and supplying the pre-charge current to the data lines D1 to Dm during the pre-charge period. And, the second control signal SEL2 is a control signal for supplying the data current to the data lines D1 to Dm during the scan period, i.e., the display period.

Pre-charge current data corresponding to each gray level of the digital video data RGB are registered in the lookup table 66. The lookup table 66 is stored at a read-only-memory ROM. The pre-charge current data registered in the lookup table 66 has a value which is divided into fixed gray level ranges, and the value is set in the ratio that the amount of pre-charge current decreases exponentially as the gray level increases as shown in FIG. 8.

In FIG. 7, the pre-charge driver 62 and the pre-charge/data controller 65 can be integrated into one chip, and the lookup table 66 can also be integrated with the pre-charge driver 62 and the pre-charge/data controller 65.

The foundation for the fact that the amount of pre-charge current should decrease exponentially as the gray level increases is as follow. In order to increase the gray level expression ability in the whole gray level range, the pre-charge current required in case that the gray level is changed in the low gray level range should be increased at a higher rate in case that the gray level is changed in the middle gray level or high gray level range which is higher than that. For example, assuming that the gray level of maximum brightness is 100% and the gray level value of data is changed at the same gray level difference, the pre-charge amount required in case that the gray level is changed from 10% to 50% is much larger than the pre-charge amount required in case that the gray level is changed from 50% to 90%.

Figure 8:
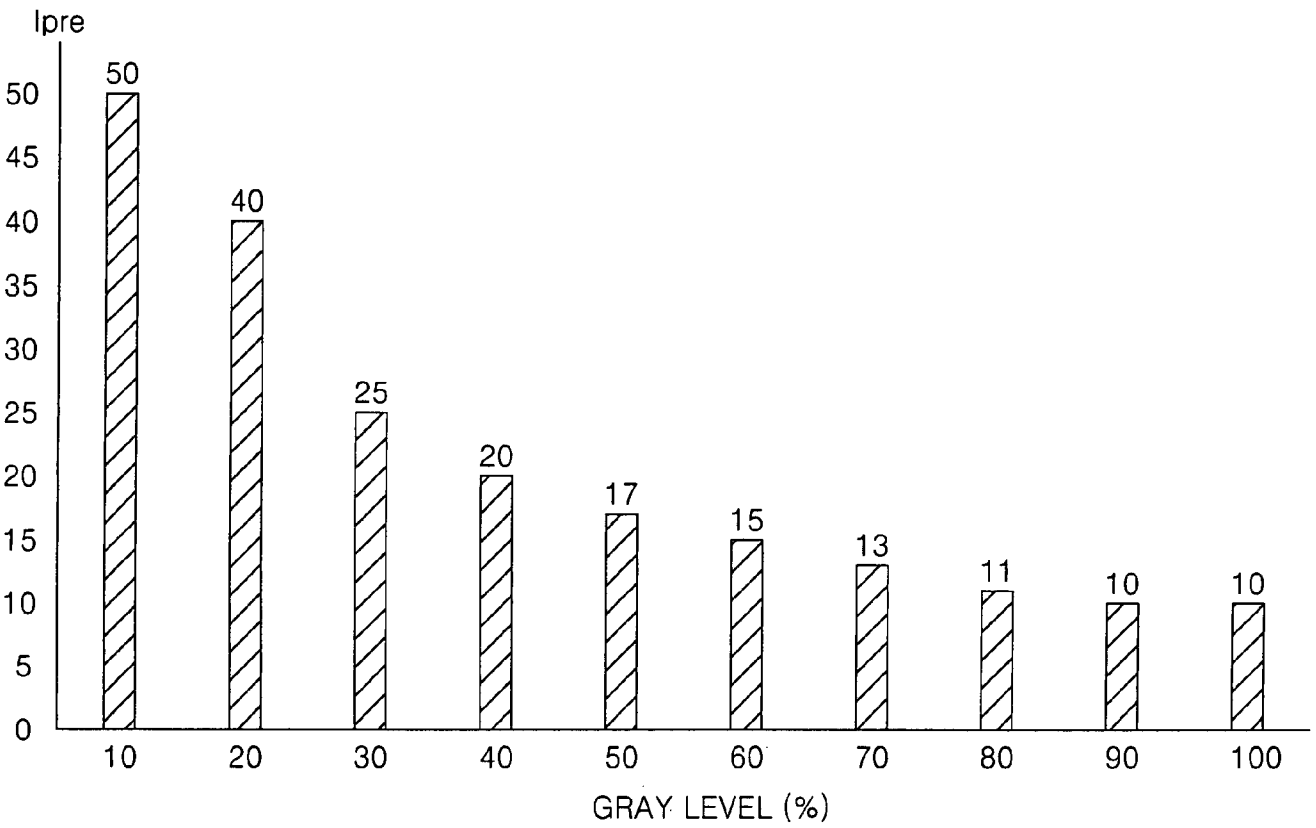
FIG. 8 is a graph representing a pre-charge current applied to the organic electro luminescence display device and a driving method thereof according to the first embodiment of the present invention.

As known in FIG. 8 by the pre-charge current data registered in the lookup table 66, assuming that the maximum brightness is 100%, in the pre-charge/data controller 65, the amount of the pre-charge current Ipre charged in the organic EL element OLED prior to the data current is 50 times the pre-set reference pre-charge current if the gray level of the digital video data RGB is 10%, but it decreases exponentially, as the gray level increases, to 10 times the reference pre-charge current if the gray level of the digital video data RGB increases to 10%.

Figure 9:
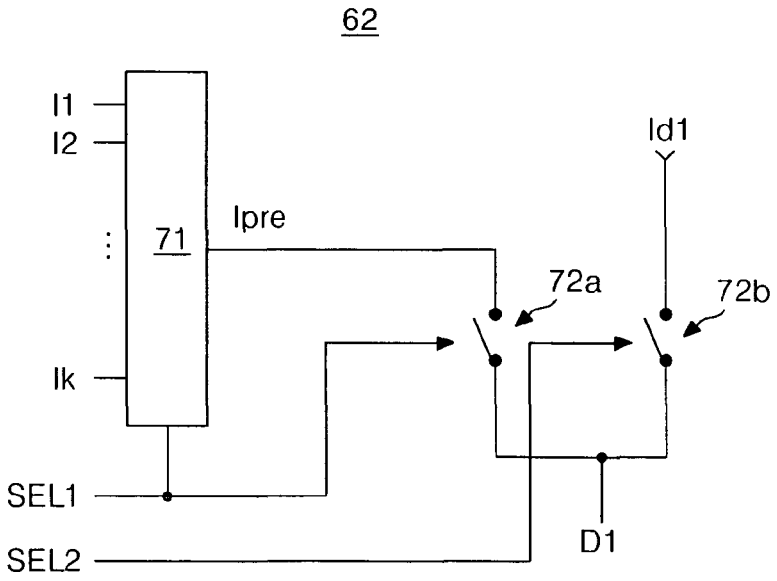
FIG. 9 is a circuit diagram representing a pre-charge driver shown in FIG. 7 in detail.

FIG. 9 represents a pre-charge driver 62 in detail.

Referring to FIG. 9, the pre-charge driver 62 includes a selection part 71 to select the current amount of the pre-charge current Ipre; a first switch device 72A to supply the pre-charge current Ipre to the data line D1; and a second switch device 72B to supply a data current Id1 to the data line D1. The second switch device 72B might be included in the data driver 61.

The current selection part 71 selects the pre-charge current Ipre from any one of k numbers (but, k is a positive integer not less than 2) of current sources I1, I2, . . . , Ik, of which the current amount are different from each other, in response to the first selection signal SEL1 from the pre-charge/data controller 65, and supplies the selected pre-charge current Ipre to the first switch device 72A.

The first switch device 72A supplies the pre-charge current Ipre selected by the current selection part 71 to the data line D1 during the non-display period prior to the display period in response to the first selection signal SEL1 from the pre-charge/data controller 65.

The second switch device 72B supplies the data current Id1 from the data driver 61 to the data line D1 for the scan period, i.e., the display period, in response to the selection signal from the pre-charge/data controller 65.

Figure 10:
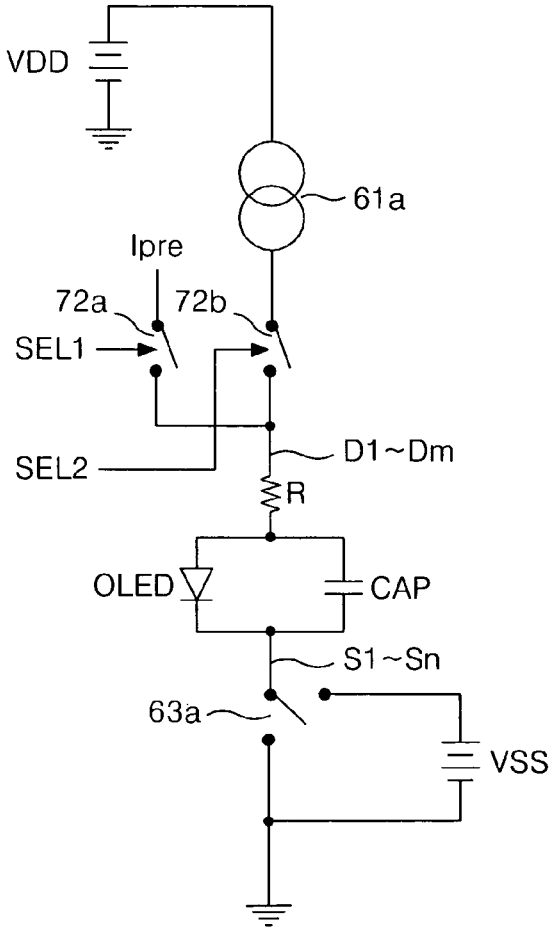
FIG. 10 is a circuit diagram equivalently representing a display panel and its drive circuits shown in FIG. 7.

FIG. 10 is a circuit diagram equivalently representing a drive circuit, signal lines D1 to Dm, S1 to Sn and an organic EL element OLED shown in FIG. 7.

Referring to FIG. 10, the reference numeral "R" is a parasitic resistor of the data line D1 to Dm, and "CAP" is a parasitic capacitance of the organic EL element OLED. And, "61A" is a constant current source included in the data driver 61 to generate the data current. "63A" is a switch device included in the scan driver 63, and it applies a ground voltage GND to the cathode of the organic EL element OLED for the display period, i.e., scan period, and supplies a positive scan bias voltage to the cathode of the organic EL element OLED for the non-display period, i.e., non-scan period. "VDD" is a high potential drive voltage applied to the constant current source, and "VSS" is a scan bias voltage applied to the cathode of the organic EL element OLED for the non-display period, i.e., non-scan period.

A driving method of the organic EL display device according to the first embodiment of the present invention will be explained in conjunction with FIGS. 10 and 11.

Figure 11:
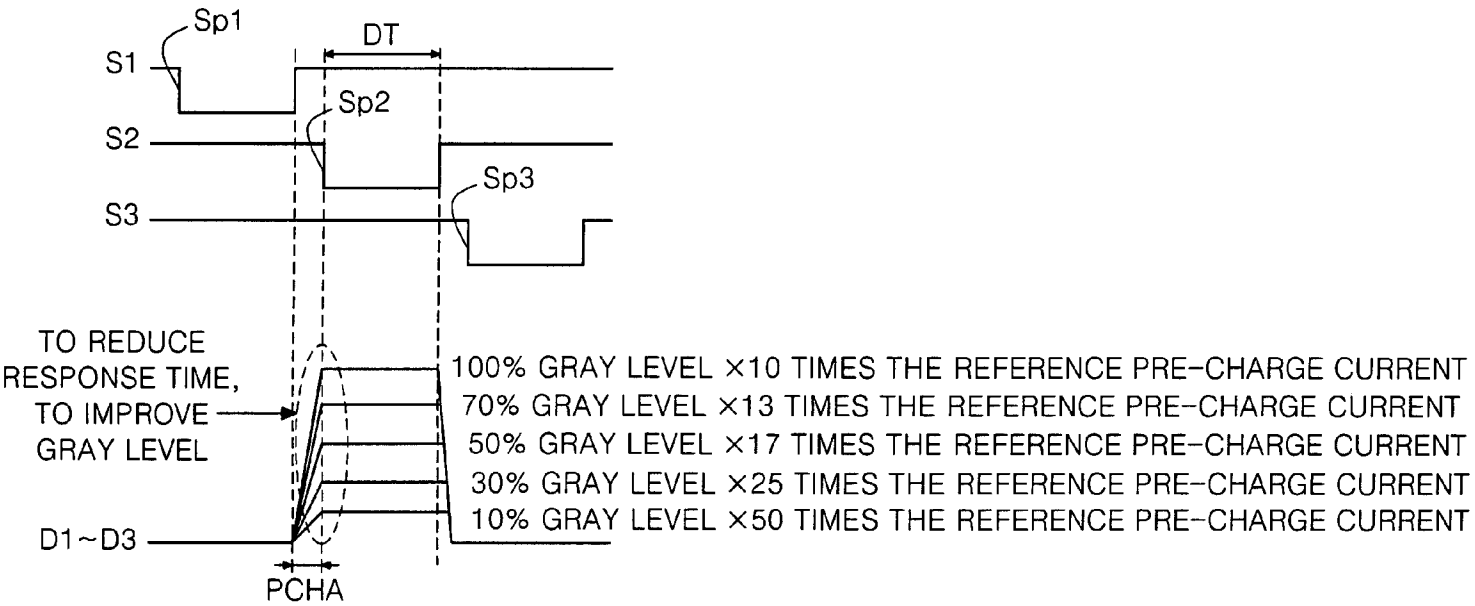
FIG. 11 is a waveform diagram explaining a drive method of the organic electro luminescence display device according to the first embodiment of the present invention.

Referring to FIGS. 10 and 11, the first switch device 72A of the pre-charge driver 62 is turned on during the pre-charge period PCHA prior to the display period DT to supply to the data line D1 to Dm the pre-charge current Ipre which is selected in accordance with the gray level of the digital video data RGB by the pre-charge/data controller 65. Then, for the pre-charge period PCHA, the organic EL elements OLED are charged with the pre-charge current Ipre of which the current amount decreases exponentially as the gray level of the data increases as in FIG. 8. The pre-charge current Ipre causes the organic EL elements OLED to be pre-charged with the greater amount of current in the low gray level to reduce the response time RT, and pre-charged with the smaller amount of current in the high gray level not to be overcharged by the overshoot, when compared with the related art pre-charge method.

Subsequently to the pre-charge period PCHA, in the display period DT, the second switch device 72B is turned on, but the first switch device 72A is turned off. Then, the data current Id1 is supplied to the data lines D1 to Dm through the second switch device 72B of the pre-charge driver 61 for the display period DT. In synchronization with the data current Id1, the switch device 63A of the scan driver 63 sequentially supplies the scan pulse of the ground voltage GND to the scan lines S1 to Sm. During the display period DT, the organic EL elements OLED emit light as the data current Id1 flows from the anode to the cathode by the positive bias.

As known in FIG. 11, the pre-charge current Ipre is applied to the organic EL elements OLED in an optimal current amount in the whole gray level range, thus the gray level is changed linearly in the whole gray level range to improve the gray level expression ability of each gray level.

On the other hand, the organic EL display device and the driving method thereof according to the first embodiment of the present invention, even though it is explained with an embodiment based on the passive method, can be applied to any known active type of organic electro luminescence display device.

Figure 12:
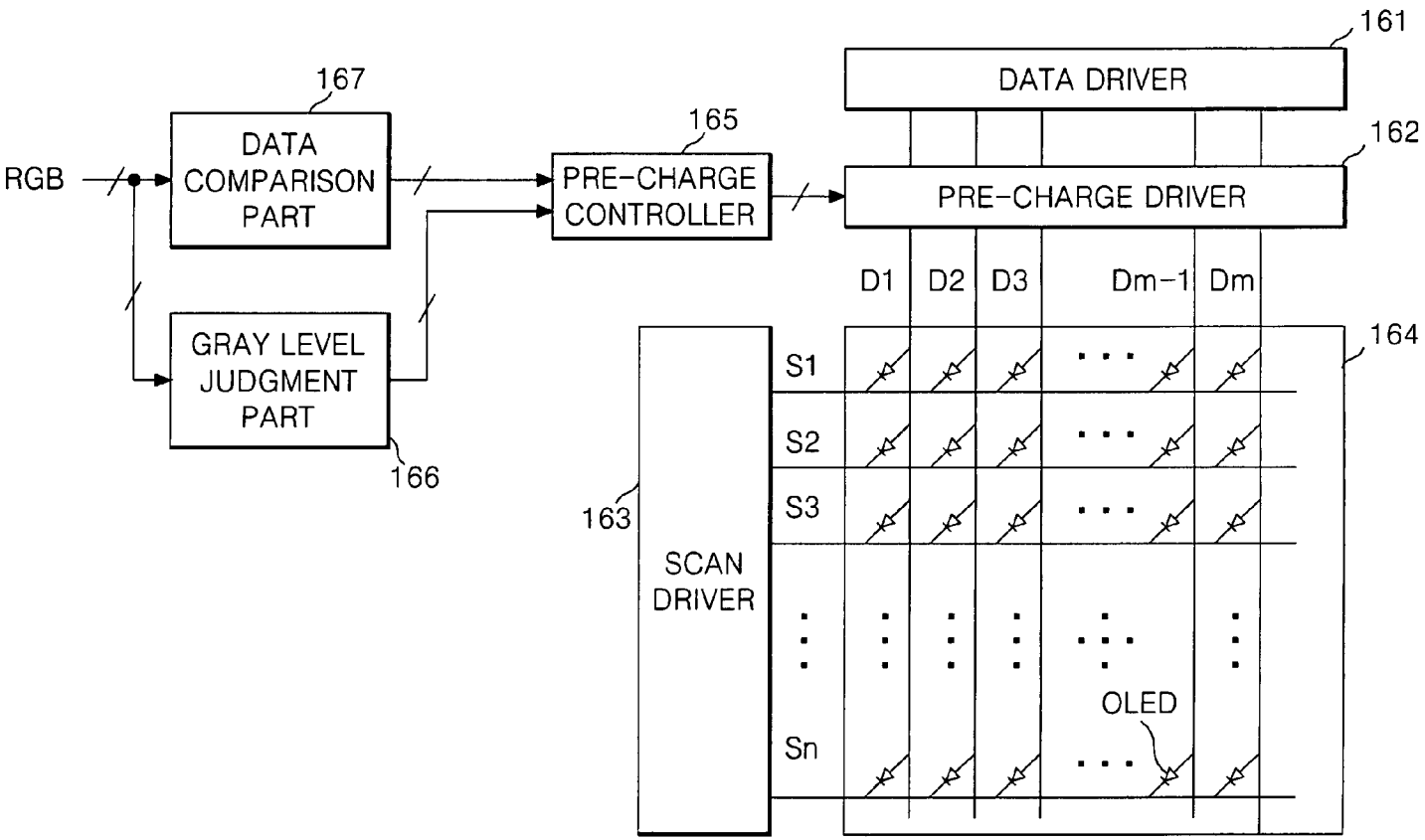
FIG. 12 is a block diagram representing an organic electro luminescence display device according to a second embodiment of the present invention.

Referring to FIG. 12, an organic electro luminescence display device according to a second embodiment of the present invention includes a display panel 164 in which m×n numbers of organic EL elements OLED are arranged in a matrix type; a data driver 161; a pre-charge driver 162; a scan driver 163; a data comparison part 167; a gray level judgment part 166; and a pre-charge controller 165.

In the display panel 164, m numbers of data lines D1 to Dm and n numbers of scan lines S1 to Sn cross each other and the organic EL elements OLED are arranged between intersections thereof.

The data driver 161 includes a shift register circuit to sequentially sample data, and a current mirror circuit or a current sink circuit. The data driver 161 samples a digital video data and supplies a data corresponding to the gray level value of the data to the data lines D1 to Dm through the pre-charge driver 162.

The pre-charge driver 162, under control of the pre-charge/data controller 65, is charged with the pre-charge current after discharging from the data lines D1 to Dm before the data below the reference gray level αgs, and selectively has the discharge generated in or charges the data lines D1 to Dm before the data of the gray level higher than the reference gray level αgs are supplied to the data lines D1 to Dm. Herein, the reference gray level αgs is a gray level that corresponds to the brightness of 30%~50% when the maximum brightness of the organic EL element OLED is 100%.

The scan driver 163 includes a shift register circuit to sequentially shift a scan pulse and sequentially supplies a scan pulse synchronized with the data current to the scan lines S1 to Sn.

The data comparison part 167 has a line memory to store the digital video data by the one line, and compares the data delayed by the line memory with the non-delayed data, i.e., compares the data of the previous line with the data of the current line, to supply the comparison result to the pre-charge controller 165.

The gray level judgment part 166 judges the gray level of the digital video data and supplies the gray level to the pre-charge controller 165.

The pre-charge controller 165 controls the pre-charge driver 162 so that the data lines D1 to Dm are charged after the discharge being generated therein for the non-scan period if the data supplied to the data lines D1 to Dm is judged to be the data below the reference gray level αgs on the basis of the gray level judgment result from the gray level judgment part 166 and the data comparison result from the data comparison part 167. Also, the pre-charge controller 165 controls the pre-charge driver 162 so that the data lines D1 to Dm are charged or the discharge is generated in the data lines D1 to Dm for the non-scan period if the data supplied to the data lines D1 to Dm is judged to be the data above the reference gray level αgs on the basis of the gray level judgment result from the gray level judgment part 166 and the data comparison result from the data comparison part 167. Herein, in case that the data is a data of the gray level higher than the reference gray level αgs, the pre-charge controller 165 controls the pre-charge driver 162 so that the corresponding data line is charged during the non-scan period between the scan period of the $(n-1)^{th}$ line and the scan period of $n^{th}$ line if the data of an $n^{th}$ line has a higher gray level value than the data of an $(n-1)^{th}$ line. But on the other hand, in case that the data is a data of the gray level higher than the reference gray level αgs, the pre-charge controller 165 controls the pre-charge driver 162 so that the discharge is generated in the corresponding data line during the non-scan period between the scan period of the $(n-1)^{th}$ line and the scan period of $n^{th}$ line if the data of an $n^{th}$ line has a lower gray level value than the data of an $(n-1)^{th}$ line.

Figure 13:
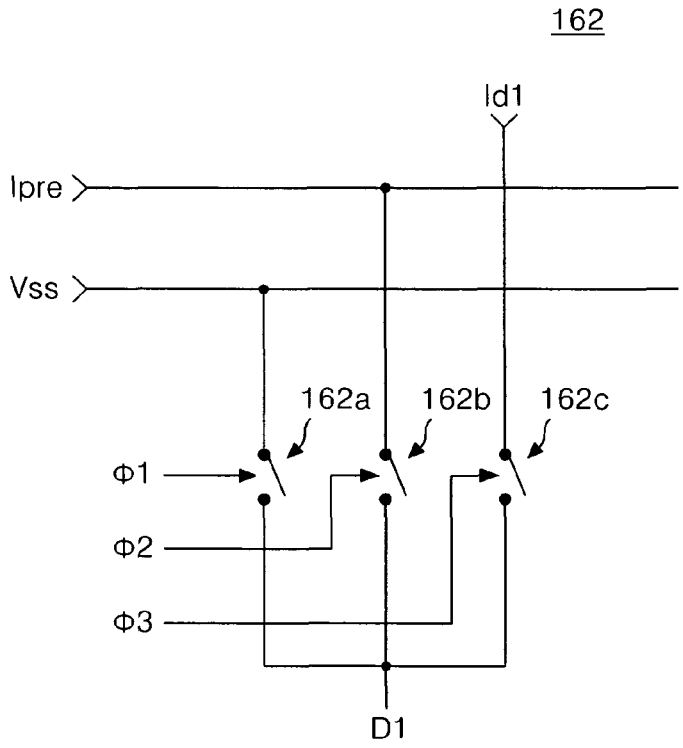
FIG. 13 is a circuit diagram representing a pre-charge driver shown in FIG. 12 in detail.

FIG. 13 represents an embodiment of the pre-charge driver 162 shown in FIG. 12.

Referring to FIG. 12, the pre-charge driver 162 includes a first switch device 162A to supply a low potential voltage Vss to the data lines D1 to Dm in response to a first control signal ϕ1; a second switch device 162B to supply the pre-charge current Ipre to the data lines D1 to Dm in response to the second control signal ϕ2; and a third switch device 162C to supply the data current Id1 to the data lines D1 to Dm in response to the third control signal ϕ3.

The low potential voltage is 0[V] or a ground voltage GND.

The control signals ϕ1, ϕ2, ϕ3 are supplied from the pre-charge controller 165.

The first switch device 162A is connected between a low potential voltage source Vss and the data lines D1 to Dn, and is turned on in response to the first control signal ϕ1 to generate the discharge in the data lines D1 to Dm.

The second switch device 162B is connected between a pre-charge current source Ipre and the data lines D1 to Dn, and is turned on in response to the second control signal ϕ2 to charge the data lines D1 to Dm with the pre-charge current Ipre.

The third switch device 162C is connected between an output terminal of the data driver 161 and the data lines D1 to Dn, and is turned on in response to the third control signal ϕ3 to supply the data current Id1 to the data lines D1 to Dm.

Figure 14:
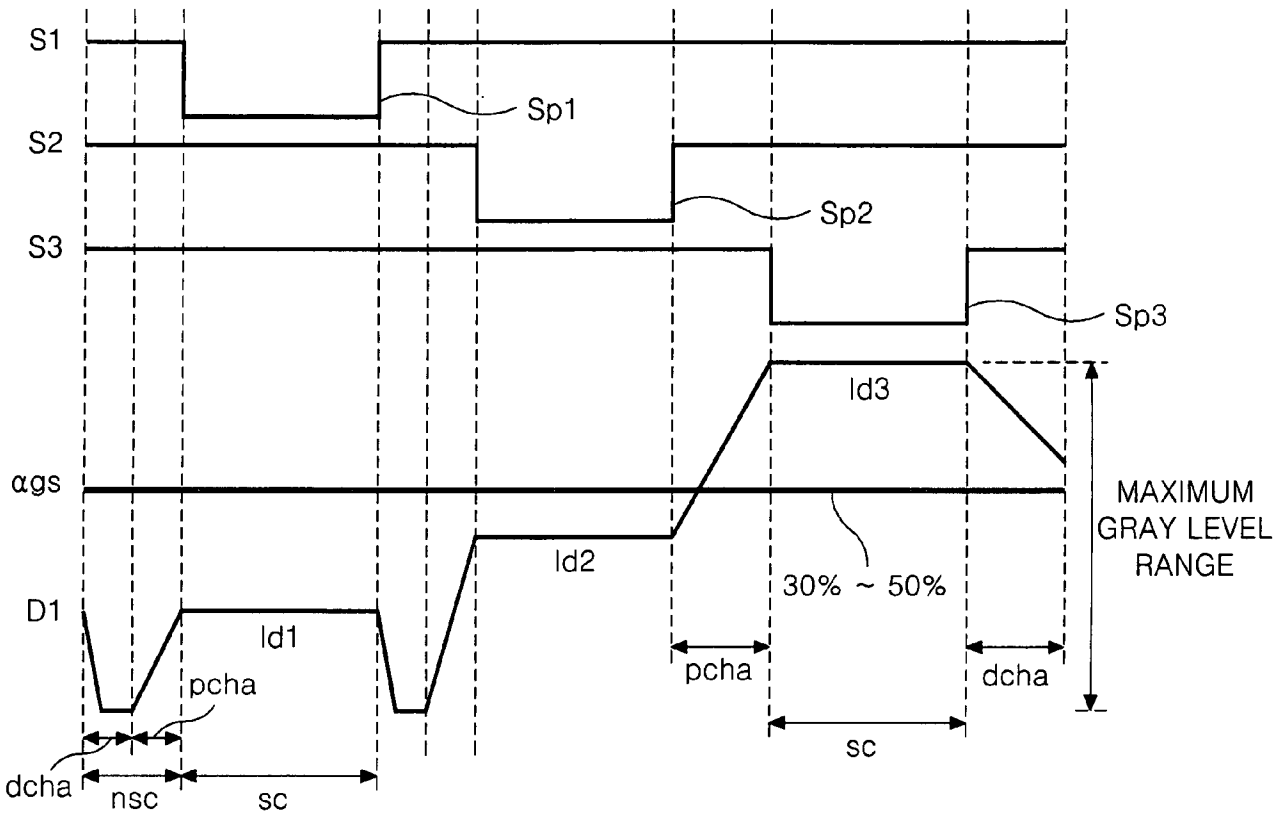
FIG. 14 is a waveform diagram explaining a driving method of the organic electro luminescence display device according to the second embodiment of the present invention.

FIG. 14 is a diagram for explaining a driving method of the organic electro luminescence display device according to the second embodiment of the present invention, and it is a waveform diagram representing a data current supplied to the first data line and a scan pulse supplied to the first and second scan lines S1, S2.

Referring to FIG. 14, the driving method of the organic electro luminescence display device according to the present invention provides a non-scan period nsc between the scan periods sc when scan pulses Sp1, Sp2 are supplied to the scan lines S1, S2, and supplies the pre-charge current Ipre after generating the discharge in the data line D1 during the non-scan period nsc between the scan periods sc when the data currents Id1, Id2 below the reference gray level are supplied. The non-scan period nsc provide between the scan periods sc when the data below the reference gray level are supplied includes a discharge period dcha and a charge period pcha subsequent to the discharge period dcha.

And, the driving method of the organic electro luminescence display device according to the second embodiment of the present invention, during the non-scan period nsc between the scan periods sc when the data current Id3 of a gray level higher than the reference gray level is supplied, supplies the pre-charge current Ipre to the data line D1 if the data current Id3 is higher than the previous data current Id2, but on the other hand, it generates the discharge in the data line D1 if the data current Id3 is lower than the previous data current Id2.

On the other hand, the organic electro luminescence display device and the driving method thereof according to the second embodiment of the present invention, even though it is explained with an embodiment based on the passive method, can be applied to any known active type of organic electro luminescence display device.

As described above, the organic electro luminescence display device and the driving method thereof according to the present invention optimizes the current amount of the pre-charge current at each gray level of the data, thus no overcharge is in the high gray level, the response speed becomes fast and the gray level expression ability can be increased in the whole gray level.

Further, the pre-charge current is charged after generating the discharge in the data line if the data supplied to the data line is a data below the reference gray level, but on the other hand, the charge or the discharge is generated in the data line in accordance with the comparison result of the data line if the data supplied to the data line is a data above the reference gray level. As a result, the organic electro luminescence display device and the driving method thereof according to the present invention might improve the gray level expression ability in the low gray level and reduce power consumption.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving method of an organic electro luminescence display device including a plurality of data lines that cross a plurality of scan lines, and including electro luminescence elements arranged at intersections of the plurality of data lines and the plurality of scan lines, the method comprising:

judging gray level values of incoming data based on a reference gray level and comparing previous data and the incoming data;

reading a plurality of different pre-charge current levels corresponding to the gray level values from a lookup table;

selectively generating first, second and third selection signals corresponding to the plurality of different pre-charge current levels, a data current and a discharge current level, respectively;

selecting one of the plurality of different pre-charge current levels from a plurality of current sources in response to the first selection signal;

supplying a pre-charge current, corresponding to the selected one of the plurality of different pre-charge current levels, to the electro luminescence elements via a first switching device and the plurality of data lines for a pre-charge period of a non-display period prior to supplying the data current, corresponding to the incoming data, so as to pre-charge the electro luminescence elements, wherein the first switching device is turned-on by the first selection signal for the pre-charge period, in response to judging a grey level value of the incoming data to be less than the reference grey level;

selecting the discharge current level in response to the third selection signal;

supplying the discharge current level to the electro luminescence elements via a third switching device and the plurality of data lines for a pre-charge period of a non-display period prior to supplying the data current, corresponding to the incoming data, so as to discharge the electro luminescence elements, wherein the third switching device is turned-on by the third selection signal for the pre-charge period, in response to judging a grey level value of the incoming data to be greater than the reference grey level and based on the comparison of the previous data and the incoming data; and subsequently supplying the data current to the pre-charged electro luminescence elements via a second switching device which is turned-on by a second selection signal for a display period subsequent to the non-display period, wherein the first switching device is turned-off for the display period.

2. The driving method according to claim 1, further comprising the step of:

sequentially supplying a scan pulse of a ground voltage to the plurality of scan lines in synchronization with the data current during the display period.

3. The driving method according to claim 1, wherein the organic electro luminescence display device includes the lookup table in which the plurality of pre-charge current levels is registered in correspondence to the gray level values, the steps of supplying the pre-charge current comprising:

identifying the gray level of the incoming data, associating the identified gray level with one of a plurality of gray levels, selecting the one of the plurality of pre-charge current levels in accordance with the one of the plurality of gray levels, and controllably supplying the pre-charge current in accordance with the one of the plurality of pre-charge current levels.

4. The driving method according to claim 1, wherein the step of selecting one of the plurality of pre-charge current levels includes the steps of:

selecting one of the plurality of current sources, each configured to supply a current having a unique current level, to supply the pre-charge current corresponding to the selected pre-charge current level; and connecting the selected one of the plurality of current sources to the plurality of data lines prior to supplying the data current to the electro luminescence elements.

5. The driving method according to claim 1, wherein the first selection signal is supplied from a controller of the organic electro luminescence display device to the plurality of current sources for selecting one of the plurality of pre-charge current levels.

* * * * *